United States Patent [19]

Green et al.

[11] Patent Number: 4,856,428

[45] Date of Patent: Aug. 15, 1989

[54] EXTRUDED PRINT CYLINDER

[75] Inventors: Melvin E. Green, Evanston; Efim Motev, Lincolnwood, both of Ill.

[73] Assignee: American Screen Printing Equipment Company, Chicago, Ill.

[21] Appl. No.: 928,290

[22] Filed: Nov. 7, 1986

[51] Int. Cl.[4] ..... B41F 1/28

[52] U.S. Cl. ..... 101/475; 29/121.3; 29/124; 101/116; 101/389.1

[58] Field of Search ..... 101/124, 382 MV, 375, 101/378, 127.1, 128.1, 126, 116, 407 R, 407.1, 408, 475, 415.1, 389.1; 29/121.1, 121.3, 121.5, 121.6, 124, 125, 129

[56] References Cited

U.S. PATENT DOCUMENTS 2,606,492 8/1952 Black ..... 101/124
3,922,772 12/1975 Ericsson ..... 101/382 MV
4,207,998 6/1980 Schmid ..... 29/121.1 X
4,617,709 10/1986 Gundlach ..... 29/124

*Primary Examiner*—Edgar S. Burr
*Assistant Examiner*—Moshe I. Cohen
*Attorney, Agent, or Firm*—Price, Heneveld, Cooper, DeWitt and Litton

[57] ABSTRACT

A printing cylinder composed of extruded equally curved cylindric sections joined at the axial edges thereof, one of said sections having a channel recess to provide for a stock gripper assembly, the other sections having axial channels in the outer periphery closed at both ends by end members, with one end member providing a means of communication between groups of these axial channels for evacuation air flow, these sections and end members being surrounded by a perforate cylindrical jacket covering said channels, and journal support shafts on the ends.

13 Claims, 4 Drawing Sheets

EXTRUDED PRINT CYLINDER

BACKGROUND OF THE INVENTION

This invention relates to print cylinders used for screen printing and the like, and particularly to a novel extruded segment cylinder construction.

Print cylinders for screen printing et al are typically cast in sections from metal stock and joined by tie bolts into a solid unitary structure containing intricate features which must be individually machined into the cylinder for providing vacuum channels, end bearings and the like. Then, the cylinder must be given an overall lathe turning to true up the periphery. Such a manufacturing process is very expensive. It results in a cylinder which is heavy and costly. The cast vacuum channel configuration is also limited in design and finish, resulting in a restricted flow of air therethrough. The cost is disadvantageous for obvious reasons. The weight is also disadvantageous because the rotating cylinder must be repeatedly stopped, then reversed, and finally rotationally restarted during printing operations. The weight of the cylinder inherently limits the printing speed because it limits the frequency of stop and start movements as well as the position accuracy of the stopped cylinder.

It is also common practice in the screen printing field to employ a cylinder which has vacuum ports on its periphery for holding sheet stock being printed. Such cylinders have air flow passages which sequentially cause the vacuum ports to first pull a vacuum on the underside of the sheet stock and then release the vacuum, all as the cylinder rotates, see e.g. U.S. Pat. No. 2,606,492 to J. A. Black, column 5 et seq. and the figures relating thereto. However, the structure of the prior cylinders to achieve this action is complex and expensive to fabricate.

SUMMARY OF THE INVENTION

The present invention is a print cylinder for screen printing and the like, having a plurality, of three extruded equally arced sections or segments to form a cylinder, one section having a channel for sheet grippers and shaft assembly, and the others being alike. The three equally arced (i.e., of equal angular extent) sections form a cylinder of thin wall dimensions. The sections have integral, axial vacuum channels from one end to the other at the outer periphery. Such sections interfit with each other and are joined to each other at their edges by bonding, as well as to a pair of end members. A perforated jacket around the periphery covers the outside of the channels, and end members cover the ends of the channels and allow air flow communication between these channels and the exterior jacket surface for vacuum holding of sheet stock. The pair of end members is sealed to the sections to close off the ends of the cylinder. A central disc supports the central portion of the surrounding sections. One end member closes off one end of the channels, while the other end member has groupings of special axial grooves aligned with groups of the axial channels for air flow communication therewith. Journal shafts extend from the ends of the assembly for journal support of the rotating cylinder.

BRIEF DESCRIPTION OF THE DRAWINGS

FIG. 5 is a perspective view of the support shaft, the two end disc members, and the center disc;

FIG. 6 is a perspective view of the subassembly in FIG. 5 but viewed from the opposite end;

FIG. 7 is a perspective view of the subassembly in FIG. 5 plus the one cylindric section that contains the gripper channel recess;

FIG. 8 is perspective view of the subassembly in FIG. 7 plus a second section;

FIG. 9 is a perspective view of the subassembly in FIG. 8 plus the third cylindric section joined to the other two sections;

DESCRIPTION OF THE PREFERRED EMBODIMENT

Figure 5:
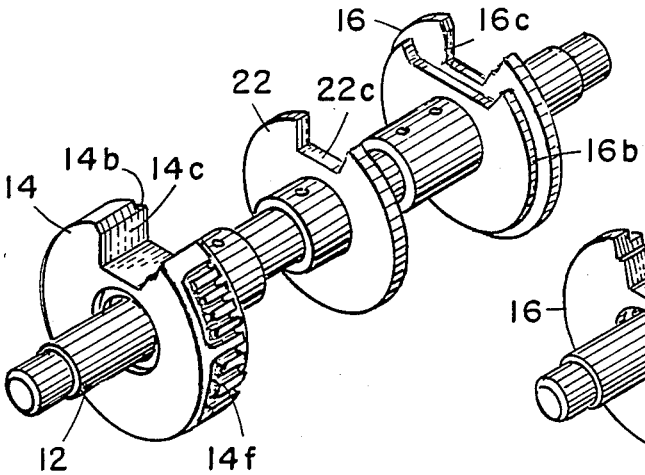
FIGS. 5–9 are perspective views showing sequential steps of assembly of the novel print cylinder to result in the assembly in FIG. 1, specifically.
Figure 6:
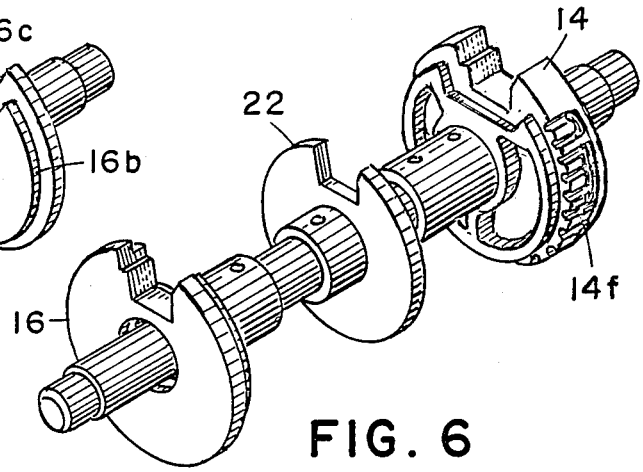

Referring now specifically to the drawings, the print cylinder assembly 10 has as the central component thereof a shaft 12 having journal bearings 12' on the opposite ends thereof. The remaining components are concentric to this shaft and its axis. These components include a first end disc member 14 at one end of the cylinder and a second end disc member 16 at the opposite end of the cylinder. These end members are keyed to shaft 12 by keys 18 and 20 respectively between a pair of keyways in shaft 12 and in the cylindrical interior collars **14*a* and 16*a* of the end members, such collars extending toward each other to be inside the assembled cylinder. A third disc 22 is mounted on shaft 12 generally intermediate the two end members 14 and 16. The outer diameter of center disc 22 is the same as that of an annular shoulder 14*b* on end member 14 and 16*b* on end member 16. These shoulders are smaller in diameter than the outer peripheral diameter of members 14 and 16, to provide an offset for receiving the cylindric sections in a manner to be described hereinafter. Each of the discs 14, 16 and 22 includes respective radial cutout recesses 14*c*, 16*c* and 22*c* respectively, of a depth and a circumferential extent equal to that of an elongated gripper channel 30*c* forming an integral portion of one of the cylindric sections, namely section 30**, to receive a gripper assembly for clamping the leading edge of sheet stock to be printed. Such conventional clamping means is not illustrated because it forms no novel part of the present invention. It can be any of several conventional clamping means available.

Around center disc 22 and around shoulders **14*b* and 16*b* of the end discs is the plurality of three cylindric sections. These are of equal curvature and angular extent, i.e., each extending 120 degrees of the periphery. Section 30, as noted previously, has the elongated gripper channel recess 30*c* formed integrally therein. Sections 32 and 34 each have a series of circumferentially spaced, axially extending grooves 32*a* and 34*a* in the outer periphery, extending from one end to the other. Preferably, cylindric section 30 that contains the gripper recess also has grooves 30***a* (FIG. 3) in the portion of its periphery alongside gripper recess 30*c*. These elongated grooves 30*a*, 32*a* and 34*a* have, in cross section, an outer entry slot 32*a* (FIG. 3) leading to an inner lobe-shaped pocket 32*a*''at the slot bottom. The lobe type pockets serve to receive and accumulate any screen printing ink and debris deposited over a period of time due to wiping the cylindrical surface with a solvent saturated cloth to clean misprints on the cylinder.

Figure 3:
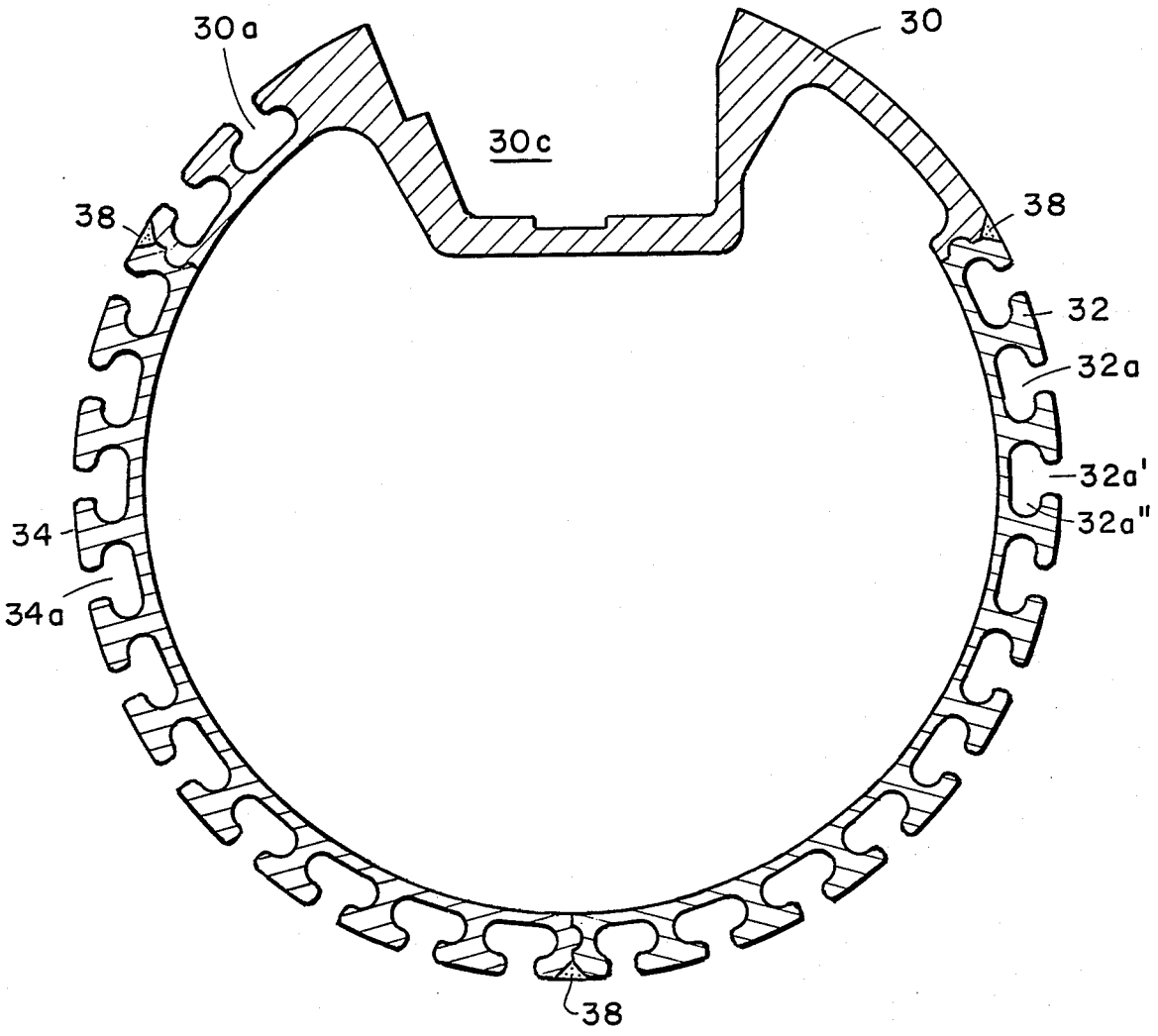
FIG. 3 is an enlarged end elevational view of the three joined equally arced sections.
Figure 12:
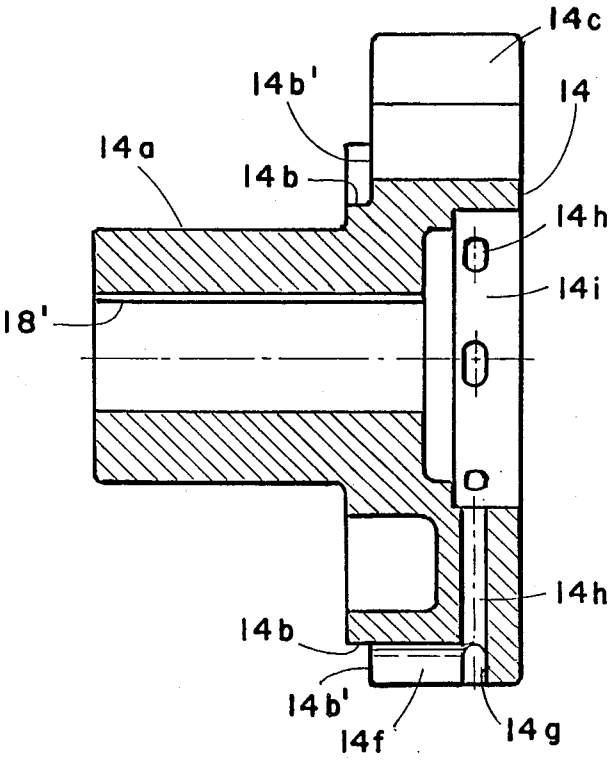
FIG. 12 is a sectional view taken on plane XII—XII of FIG. 10.

These thin walled, cylindric sections are each formed of extruded aluminum or aluminum alloy. The combined sections are very lightweight and require no extensive machining. The axially extending edges of the three sections interfit with each other optionally aligned with a tongue and groove arrangement as depicted in FIG. 3. Thus, each section can have an axially elongated tongue on one edge and an axially elongated groove on the other edge for this purpose. The adjacent edges also define an outer axial recess for receiving weldment 38 (FIG. 3) to join them securely.

Figure 10:
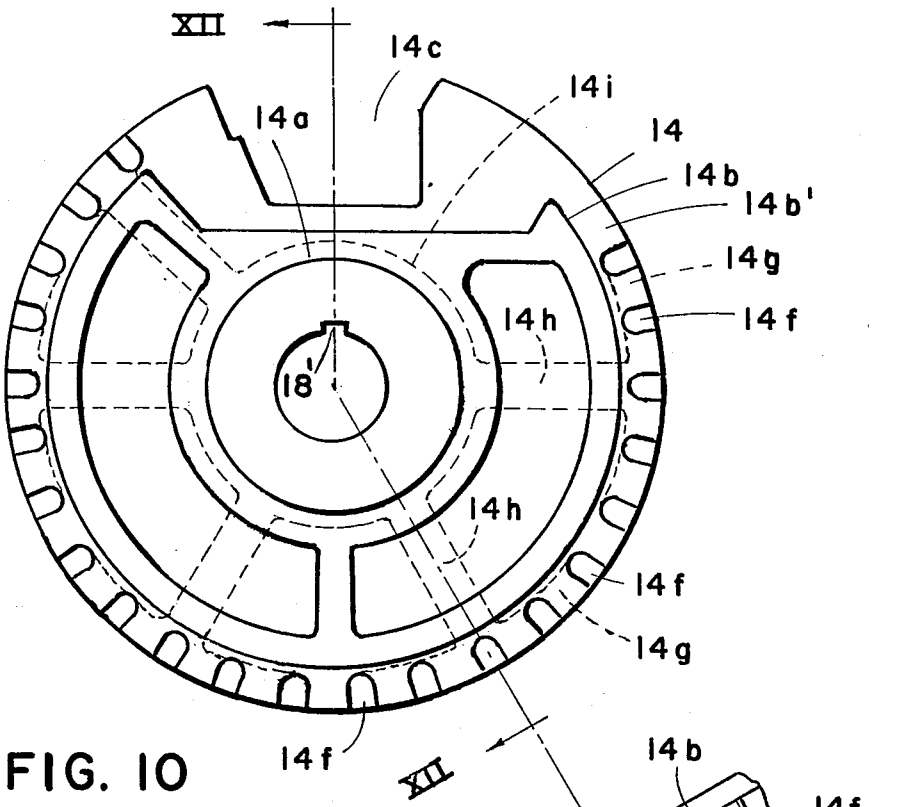
FIG. 10 is an end elevational view of one of the end members.
Figure 11:
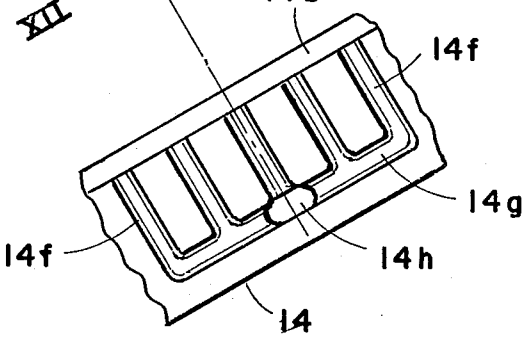
FIG. 11 is a fragmentary view of a portion of the periphery of the end members in FIG. 10.

The two end members, basically disc-shaped in configuration, close the axial ends of the cylinder. As noted, sections 30, 32 and 34 extend around shoulders 14*b* and 16*b* and abut against the radial walls 14*b*' and 16*b*' to which they are sealed. End member 16 closes off one end of the suction grooves 30*a*, 32*a* and 34*a*. End member 14 has a series of axial grooves 14*f* in its periphery. These grooves are in groups, with several (here shown to be four or five in number) of such grooves being in each group. These several grooves in each group are in communication with each other by an interconnecting cross groove 14*g* (see FIGS. 8 and 11 for example). Thus, on the member in FIG. 10, there are five groups of grooves. Each group has a radially extending passage 14*h* extending from the cross groove 14*g* to the annular axial recess 14*i* surrounding the end shaft. This annular recess connects to a conventional manifold (not shown) that causes passages 14*h* to be sequentially exposed to a vacuum source (not shown) and then to atmospheric pressure.

Figure 7:
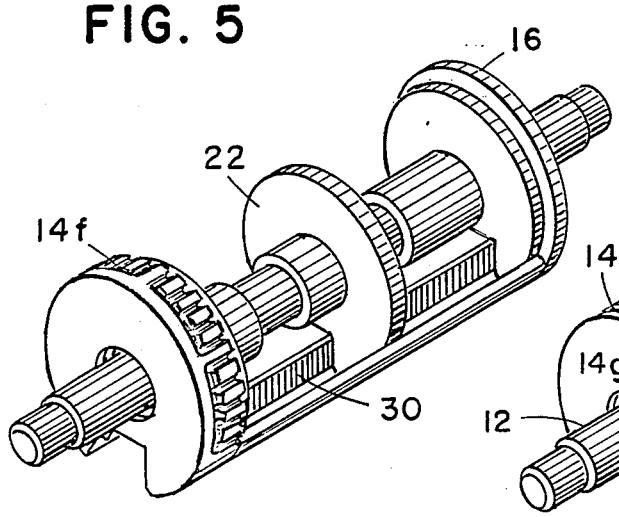
Figure 8:
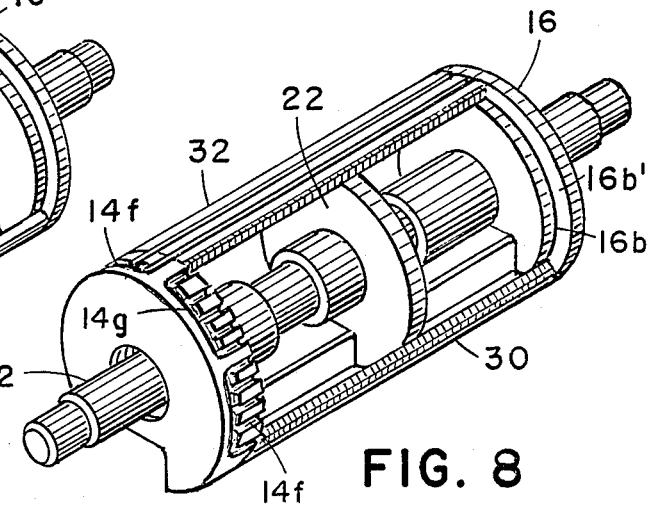
Figure 9:
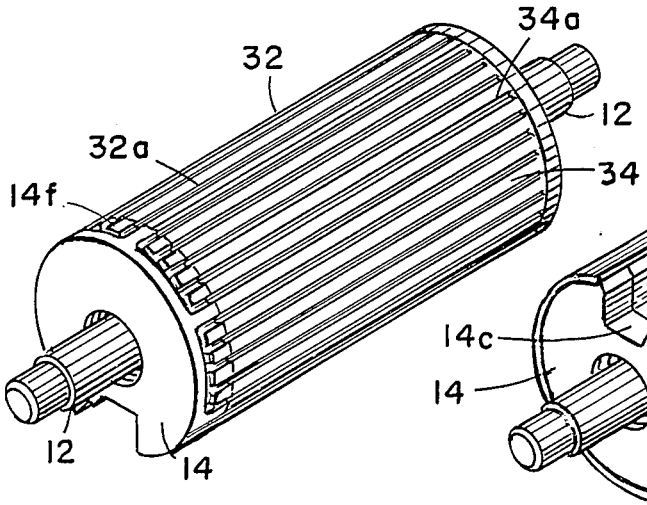
Figure 1:
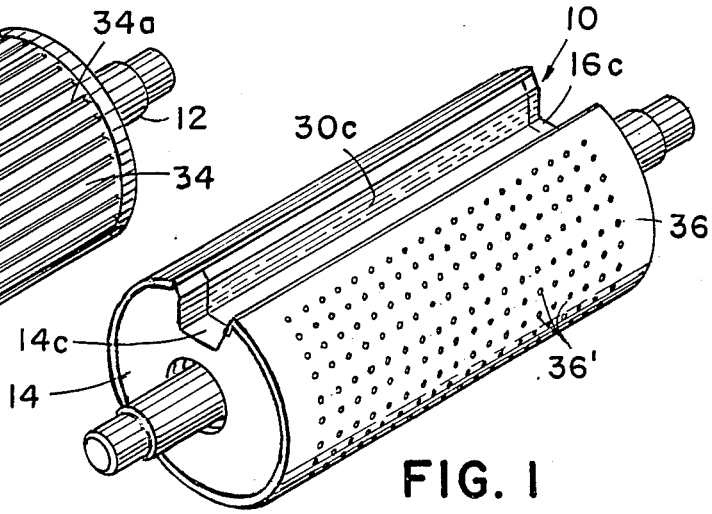
FIG. 1 is a perspective view of the assembled print cylinder.
Figure 2:
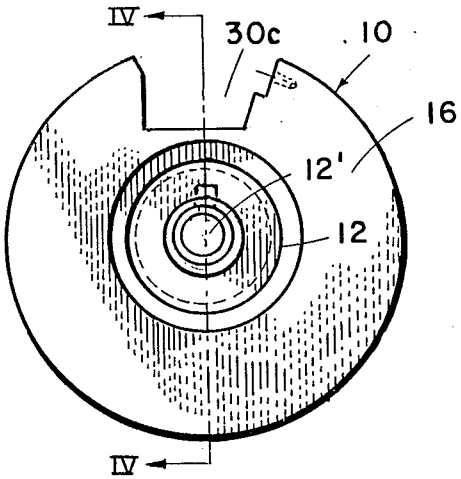
FIG. 2 is an end elevational view of the assembled cylinder.
Figure 4:
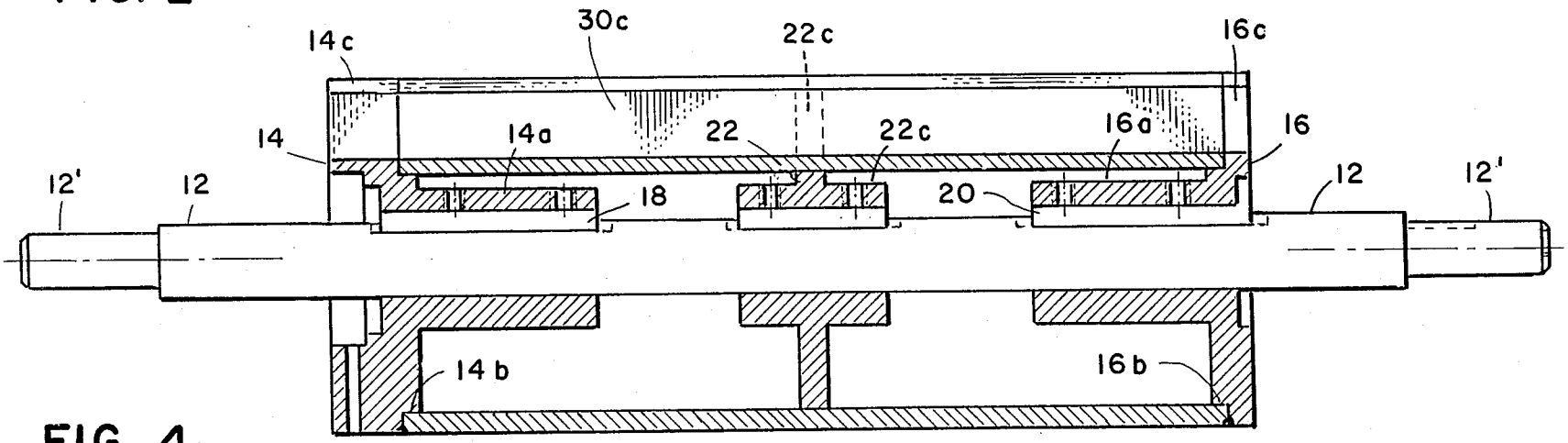
FIG. 4 is a sectional view of the cylinder taken on plane IV—IV of FIG. 2.

During assembly, normally the three segments will be placed in position in sequence e.g. as in FIG. 7–9. Section 30 is first placed in engagement with the shoulders of the end members and the periphery of center member 22, then as in FIG. 8, section 32 is placed in position with its edge interfitting with the adjacent edge of section 30, and resting on the shoulders 14*b* and 16*b*, and finally section 34 (FIG. 9) is placed in engagement with the sections 30 and 32. Then all three are welded together with weldments 38 to bond them into a unitary cylinder.

Around the periphery of the sections, except for the region of the gripper channel recess, is placed a stainless steel skin or jacket 36 which has perforations i.e. orifices 36' therethrough aligned with the grooves 30*a*, 32*a* and 34*a*. This provides air flow communication between the grooves and the exterior of the skin so that a negative pressure drawn upon the grooves 14*f* and therefore upon the grooves 30*a*, 32*a* and 34*a* will cause the negative pressure to be communicated to the drum periphery for retaining sheet stock in tight adhering relationship thereto for a desired period of time as the sheet stock is printed. Typically, vacuum will be pulled on one portion of the cylinder channels at a time, and then released. That is, successive arcuate portions of the rotating cylinders are evacuated as taught in the Black Patent 2,606,492 previously noted.

The overall combination is comparatively light in weight so that it can be utilized for high speed printing, being capable of rapid acceleration and deceleration to an accurate stopped position for registry of sheet stock being fed thereto. Further, it does not require complex or expensive machine operations. Moreover, the air flow path for the vacuum function is smooth and shaped to reduce friction, allowing repeatedly rapid evacuation of the sequentially advancing channels.

Additional advantages of the structure will be apparent to those in the art.

Conceivably certain details of the construction could be modified to suit particular circumstances or printing operations. It is not intended that the preferred embodiment depicted and described be limiting of the scope of the invention. The invention is intended to be limited only by the scope of the appended claims and the reasonably equivalent structures to those defined therein.

The embodiments of the invention in which an exclusive property or privilege is claimed are defined as follows:

1. A printing cylinder comprising:

a plurality of arcuate cylindric extruded sections, each section having a pair of opposite axial edges in engagement with adjacent sections;

one of said sections having a gripper channel therein for receiving sheet stock gripper mechanism;

said sections each having channels in the outermost periphery thereof, extending axially from one end of the section to the opposite end, open through both ends of the section;

said edges of said sections being bonded together to form an integral cylinder;

a perforated jacket around the entire periphery of said integral cylinder except for the peripheral extent of the gripper channel, over the periphery of said channels allowing vacuum communication to the outer surface of said jacket; and a pair of axial end members attached to said cylinder, covering the ends of said cylinder and said channels, and providing axial bearing journals for the printing cylinder.

2. The printing cylinder in claim 1 wherein said extruded sections other than said one extruded section are alike.

3. The printing cylinder in claim 2 wherein said other sections are identical sections.

4. The printing cylinder in claim 1 wherein said sections are equally arced sections.

5. The printing cylinder in claim 1 wherein said sections are equiangular cylindric trisections.

6. The printing cylinder in claim 1 wherein said axial end members have recesses complementary to and aligned with said gripper channel of said one section.

7. The cylinder in claim 1 wherein said sections are of aluminum and said jacket is of stainless steel.

8. The cylinder in claim 1 wherein one of said end members has grooves in communication with portions of said channels and has outlet means for connection to a suction source, for applying suction to portions of said channels.

9. A printing cylinder comprising:

a plurality of arcuate cylindric extruded sections, each section having a pair of opposite axial edges in engagement with adjacent sections;

one of said sections having a gripper channel therein for receiving sheet stock gripper mechanism;

said edges of said sections being configurated to interfit with each other and form a cylinder;

axially extruding air flow channels in the outermost periphery of said sections, groups of said channels being interconnected at at least one end thereof;

a jacket around the entire periphery of said cylinder except for the peripheral extent of the gripper channel and over the periphery of said air flow channels, said jacket being perforate to allow vacuum communication between the outer surface thereof and said air flow channels during printing;

a pair of axial end members closing the ends of said cylinder, and axial bearing journals for the printing cylinder.

10. The printing cylinder in claim 9 wherein said sections are equally arced cylindric section.

11. The printing cylinder in claim 9 wherein said configurated edges have a tongue and groove interfit.

12. The printing cylinder in claim 11 wherein said edges when fitted together leave an axial recess containing a bonding bead for bonding said sections into an integral cylinder.

13. The printing cylinder in claim 9 wherein said air flow channels contain an outer slot and an inner lobe-shaped pocket to receive debris and ink.

* * * * *